United States Patent [19]

Stephenson et al.

[11] 4,362,348

[45] Dec. 7, 1982

[54] EMI: X-RAY PROTECTED MULTI-CONTACT CONNECTOR

[75] Inventors: Roger C. Stephenson, Woodland Hills; Dale T. Chaput, Yorba Linda, both of Calif.

[73] Assignee: Automation Industries, Inc., Greenwich, Conn.

[21] Appl. No.: 165,648

[22] Filed: Jul. 3, 1980

[51] Int. Cl.[3] ..... H01R 13/629; H01R 13/658

[52] U.S. Cl. ..... 339/75 M; 339/143 R

[58] Field of Search ..... 339/17 CF, 75 R, 75 M, 339/143 R, 136 R, 136 M, 147 R

[56] References Cited

U.S. PATENT DOCUMENTS

| | | | |
|---|---|---|---|
| 2,762,025 | 9/1956 | Melcher | 339/143 R |
| 3,550,065 | 12/1970 | Phillips | 339/94 M |
| 3,594,694 | 7/1971 | Clark | 339/75 M |
| 4,083,619 | 4/1978 | McCormick et al. | 339/75 M |
| 4,202,591 | 5/1980 | Borgstrom | 339/143 R |

*Primary Examiner*—John McQuade

*Attorney, Agent, or Firm*—Francis N. Carten

[57] ABSTRACT

The invention is directed to a multi-contact electrical connector, especially a flat pack connector. The housings for plug and receptacle are X-ray absorbent metal to substantially decrease X-ray penetration. The receptacle face has perforations in the housing metal of dimensions to function as an EMI Grid to shield against RFI entry through the wave guide perforations. Also the perforations are long enough to substantially shield the sockets from X-rays striking the perforations at an angle. The plug and receptacle are locked in mated relation by collet fingertips which close to a ball shape for entry and exit from a receptacle recess, and open wide to a diameter larger than the entry/exit opening in the recess to lock the plug and receptacle in the mated position. A spring loaded plunger rod maintains the locked position. The tug of a lanyard releases the spring load and the fingertips close, are pulled out of the recess by another spring, unlocking the connector and also separating the receptacle from the plug.

4 Claims, 21 Drawing Figures

LOCK
MATE
350
365
300
310
360
370
230
318
340
312
330
235
259
231
320
315
127
132
134
-130-
224
216
214
208
212
-210-
206
117
218
226
106
104
110
-114-
108
116
112
118
126
120
200
202
100
102

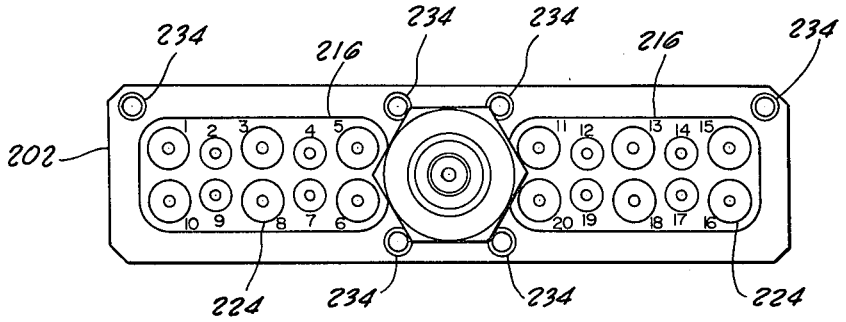
FIG. 14.
FIG. 13.
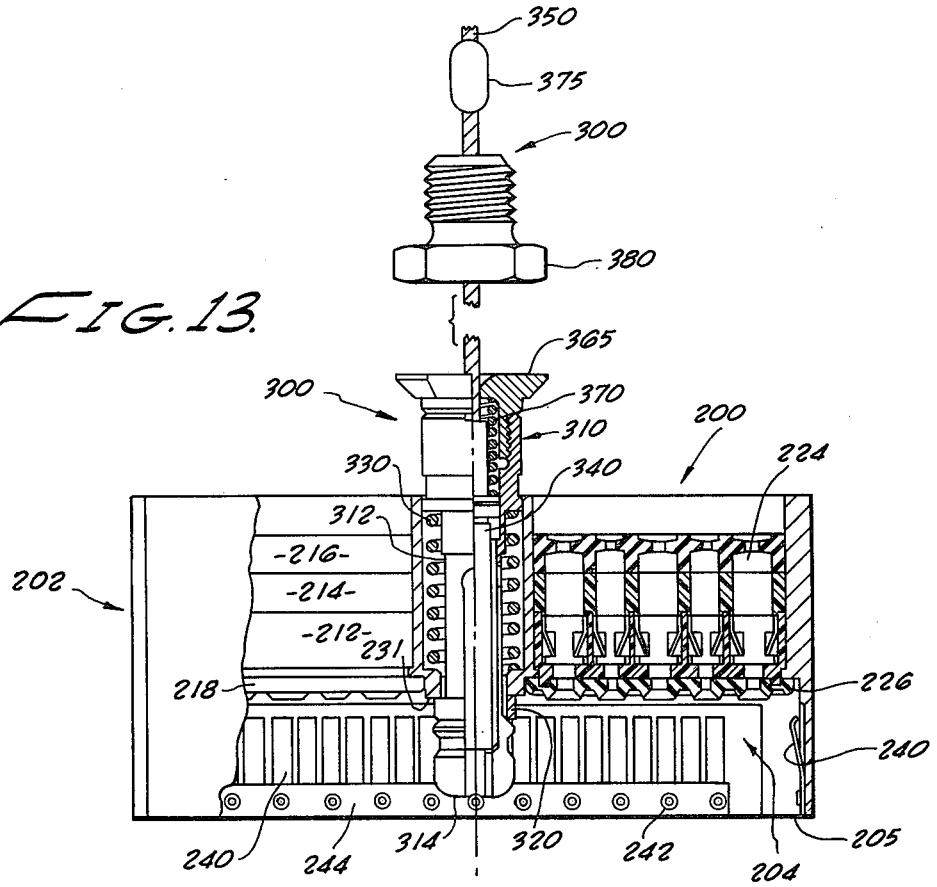

EMI: X-RAY PROTECTED MULTI-CONTACT CONNECTOR

BACKGROUND OF THE INVENTION

1. Field of the Invention

This connection relates to multi-contact electrical connectors. Particularly, the invention relates to X-ray radiation resistant connectors. More particularly, the invention relates to a receptacle section of a connector which receptacle is resistant to radio frequency interference and to X-ray radiation interference.

2. Description of the Prior Art

Multi-contact electrical connectors are expected to shield out at least a substantial proportion of the electromagnetic energy given off by natural sources or by man-made electronic devices or explosions, such as radar over naval vessels and military air bases, the electromagnetic pulses (EMP) resulting from a nuclear explosion. It is desirable to shield against both radio frequency radiation (RFI) and against X-ray radiation. RFI radiation entering by way of a connector can upset or even black out for a time the internal electrical circuitry to which the connector is wired. X-ray radiation which penetrates the connector can generate spurious electrical impulses in the conductors and damage the non-metallic materials, such as plastic insulators and organic coatings on wire leads from internal circuitry to the connector.

In general, various connectors are known which more or less acceptably perform one, but not both, of these shielding functions.

When a connector is disengaged (unmated) the receptacle is normally open to the atmosphere and radiation which strikes on the open face of the receptacle readily enters the internal circuitry by way of the exposed sockets. Various expedients for eliminating this entry have been tried. Metal trap doors are the most commonly used. These trap doors are complex and have low reliability. Severe radiation environments tend to decrease the protection provided by such doors. An especially efficient shield for RFI in open faced receptacles is provided by the "EMIGrid" system disclosed in J. J. Phillips U.S.A. Pat. No. 3,550,065, granted Dec. 22, 1970.

Most electrical connectors are provided with locking-unlocking devices. A collet finger device working on the outer periphery of the receptacle housing is disclosed in T. A. Clark U.S.A. Pat. No. 3,594,694, granted July 20, 1971.

Some electrical connectors are provided with center lock-unlock mechanisms. Flat pack connectors can conveniently use center locks. The present connectors using center locks are extremely leaky to EMI in the flat pack configuration.

OBJECTS

The principal object of the invention is to provide an open faced receptacle section of an electrical connector with substantial resistance to both (RFI) and X-ray radiation penetration.

Another object of the invention is an electrical connector having substantial resistance to X-ray radiation penetration.

A particular object of the invention is an electrical connector having a center lock mechanism which is essential closed to EMI leakage.

Other objects of the invention will be apparent in the detailed description herein.

BRIEF DESCRIPTION OF THE DRAWINGS

FIG. 13 is a partial sectional view of the plug section with the mating opening at the lower end of the plan view.

FIG. 14 is a view of the top of the plug section, looking down on FIG. 13.

SUMMARY OF THE INVENTION

Figure 1:
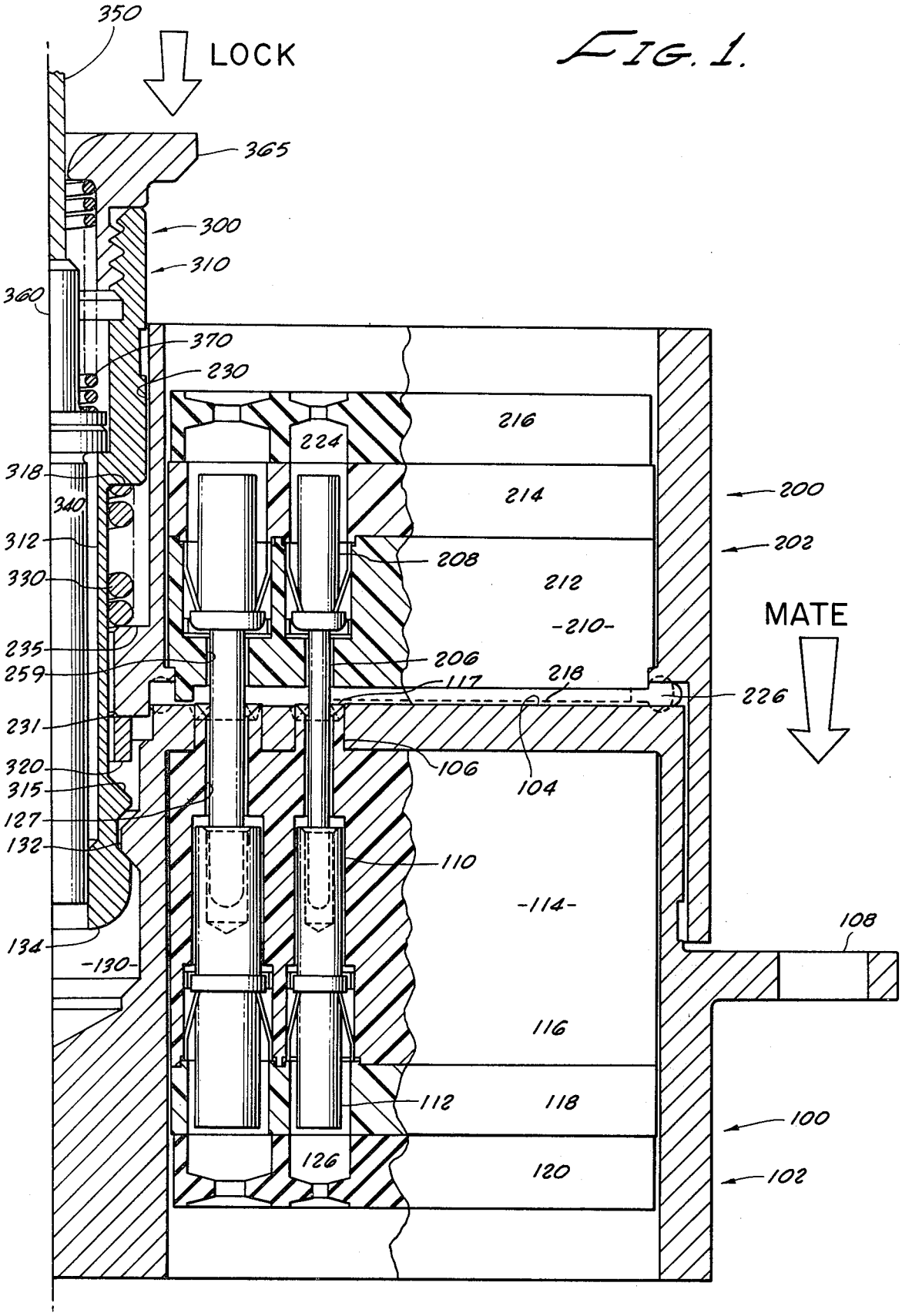
FIG. 1 shows a cross sectional view of one half of the electrical connector in mated and locked relation.

The multi-contact electrical connector of the invention in the preferred embodiment comprises: a receptacle section with shielding capability against RFI and X-ray radiation; a plug shell with X-ray attenuation capability; and locking-unlocking means to hold the mated relation.

The receptacle section comprises: a conductive metal housing for mating with a plug section, including a perforated face, said metal is capable of absorbing a substantial amount of X-ray radiation striking said face. The face is thick enough to cause X-ray radiation entering said perforations, at an angle to the face, to be shielded from striking the electrical sockets positioned beneath the perforations in the face. Those X-rays which are permitted to enter by way of the perforated face, are essentially parallel to the long axis of the sockets and, therefore, sufficient metal exists in the sockets to absorb the X-rays so that they do not pass through and knock off electrons on the far side, which electrons would set up an electrical imbalance and cause current to flow. The dimensions of said perforations are selected to form wave traps having a cut off frequency above the frequency of radio frequency electromagnetic energy striking the face during operational use of the receptacle. Positioned beneath the face is an insulator insert which encloses the sockets lengthwise. Desirably the insert includes X-ray radiation absorbing material, such as, powdered metal. Preferably, the receptacle housing is made from nickel, nickel alloy, or nickel plated stainless steel. The receptacle is wired to the vehicle, or other structure to which the receptacle is attached, by electrical leads from the rear of the sockets. The receptacle includes a recess for receiving a connector locking-unlocking means, when the receptacle and the plug sections are mated. Preferably the receptacle is part of a flat pack connector.

The plug section comprises: a conductive metal housing for mating with said receptacle section, with the plug section metal housing being capable of absorbing a substantial amount of the X-ray radiation striking the plug section. An insert is positioned within the plug section housing. The plug insert encloses a portion of the length of electrical pin contacts for making electrical connection with the sockets of the receptacle and also encloses the barrel portion of the pins for receiving electrical leads.

The means for locking the receptacle and the plug in mated condition and for rapidly unlocking the receptacle and the plug and disengaging the receptacle and the plug from the mated relation comprise: In combination with the plug section, a tubular means terminating in collet fingers, each finger terminating in a finger tip, and all the fingertips are capable of closing to a roughly ball shape and opening to an expanded diameter. A plunger movable longitudinally within said collet fingers and said collet fingertips, whereby the plunger is in the extreme forward position the finger tips cannot move inwardly and are locked in the expanded position with a recess included in the receptacle housing. Spring means associated with the plunger for maintaining the plunger in the forward position. Spring means associated with the tubular means for imparting rearward force on said collet fingertips and a constant mating force driving the receptacle and plug together. Preferably, the locking-unlocking means includes a lanyard. A pull on the lanyard overcomes the plunger associated spring force and withdraws the plunger sufficiently to allow the fingertips to assume the ball shape, permitting the fingertips to escape from the recess.

Preferably the plug housing includes conductive metal fingers positioned in the exposed pin portion of the plug housing which fingers improve electrical conduction contact of the plug and receptacle housings when the connector is in the mated relation.

The preferred connector has a flat pack configuration.

DESCRIPTION OF A PREFERRED EMBODIMENT

The figures illustrate a flat pack connector which is a preferred embodiment of the invention. This invention is equally applicable to cylindrical connectors or variants of the flat and cylindrical configurations.

FIG. 1 shows one-half, cut at the longitudinal center line, of the wide side of the flat pack connector in a partial cross sectional view. FIG. 1 shows receptacle section 100 electrically mated (engaged) with plug section 200. The large arrow MATE shows the direction of movement of the plug section 200 in order to mate with receptacle section 100. The large arrow LOCK shows the direction of movement of locking-unlocking means 300 to lock the sections 100 and 200 after mating.

Figure 2:
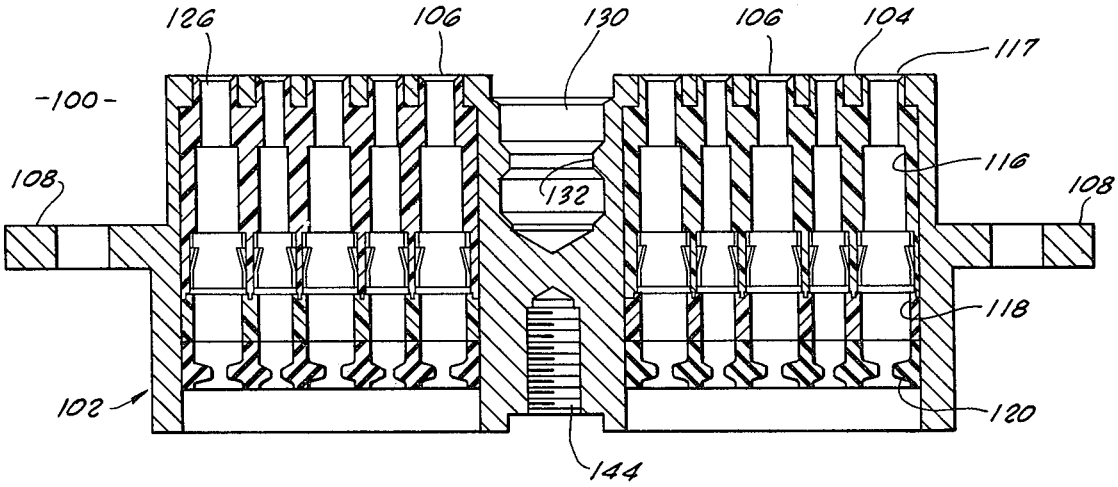
FIG. 2 shows a cross sectional plan view of the receptacle.
Figure 3:
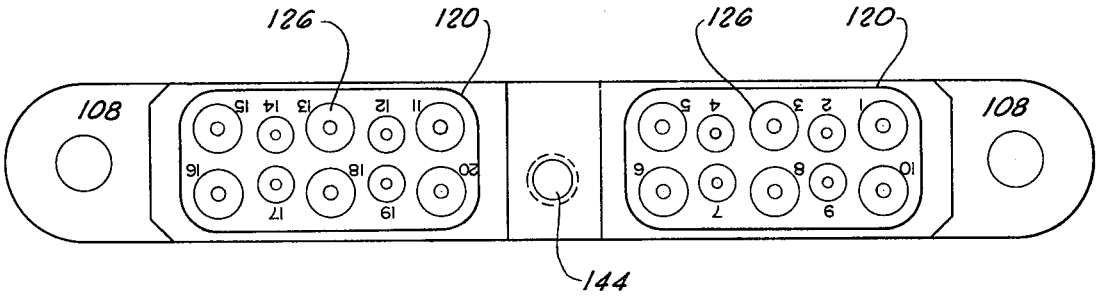
FIG. 3 is a view from the bottom, looking up, of the receptacle as shown in FIG. 2.

Receptacle section 100 includes a conductive metal housing 102. Housing 102 is capable of absorbing X-ray radiation and is thick enough to absorb a substantial amount of the X-ray radiation striking the exposed (open) surfaces of receptacle 100. Nickel, nickel alloy or nickel plated stainless steel are preferred. Receptacle 100 has a face 104, herein a flat face, having a number of perforations 106. Only two perforations are shown in FIG. 1; a plurality of perforations are shown in FIG. 2–5. Receptacle housing 102 is provided herein with two mounting ears 108 (FIGS. 1–2).

Receptacle housing face 104 is thick enough to cause X-ray radiation entering perforations 106, at an angle to face 104, to be shielded from striking the electrical contact pin sockets 110 positioned beneath perforations 106, i.e. the sockets are in the shadow of the perforations.

Each pin socket 110 includes crimp barrel 112 for receiving an electrical lead, not shown, which lead connects the socket 110 to the electrical system of the vehicle, or other structure, to which the receptacle section 100 is attached.

Figure 12:
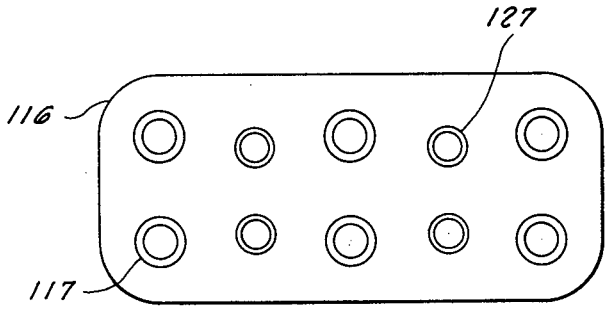
FIGS. 11–12 are a partial section of a plan view and top view of an insert for use in the receptacle.
Figure 11:
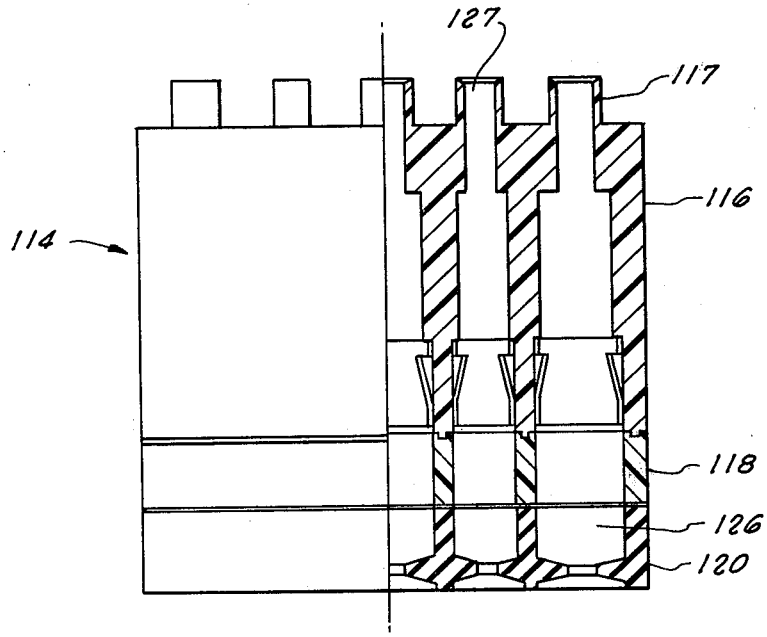

In FIG. 1 an electrical insulator 114 is positioned inside housing 102, beneath face 104, enclosing sockets 110 lengthwise. This embodiment utilizes two inserts, as shown in FIG. 2. FIGS. 11–12 show an enlarged view of on insulator 114. Herein each insert consists of three pieces 116, 118 and 120 which will be described in more detail in connection with FIGS. 11–12. At this time, note the extensions 117 (FIGS. 1, 2 and 11) which insulate face 104 perforations from socket 110 and pin 206.

In FIG. 1, plug section 200 includes a plug housing 202 having electrical contact pins 206 which include crimp barrels 208 surrounded by opening well 204 (see FIG. 13). Crimp barrels 208 receive leads, not shown, for connecting by way of the mated pins and sockets of the connector the vehicle electrical system to an outside system.

Plug housing 202 is made of conductive, X-ray absorbent, metal; the same metal may be used in the receptacle housing 102. The metal of housing 202 is capable of absorbing a substantial amount of X-ray radiation striking plug section 200.

Insert 210 is positioned inside housing 202. Herein, insert 210 is made up of three pieces 212, 214 and 216. There is an elastomer interface seal 218 positioned on the pin end of insert 210, which seal provides enviromental protection to the pin openings 259 (see FIG. 20) and socket openings 127 (see FIG. 11) in inserts 210 and 114. Fluorosilicone rubber is a preferred material for the interface seal.

There is provided means for locking receptacle section 100 and plug section 200 in the mated relation; and then disengaging these sections 100 and 200. In FIG. 1 these associated locking-unlocking means are given the collective identification numeral 300. It is to be understood that this is only a preferred form of such means; preferred because of its efficiency and low EMI leakage. Other types of such means can be used with the defined receptacle and defined plug sections to provide a connector of acceptable RFI and X-ray attenuation.

Receptacle housing 102 is provided with a recess 130 for cooperation with said locking and unlocking means 300 to obtain and to maintain a locked relation of the two sections 100 and 200.

Figure 5:
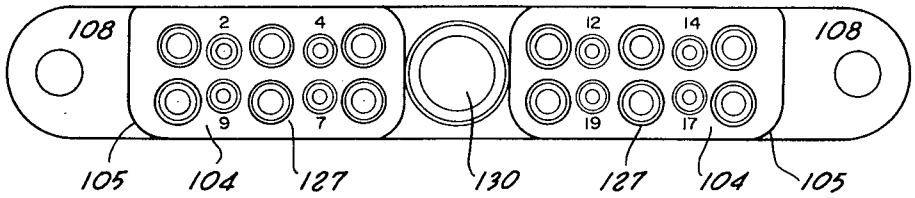
FIG. 5 is a top view looking down, of the receptacle as shown in FIG. 4, at line 5—5.
Figure 4:
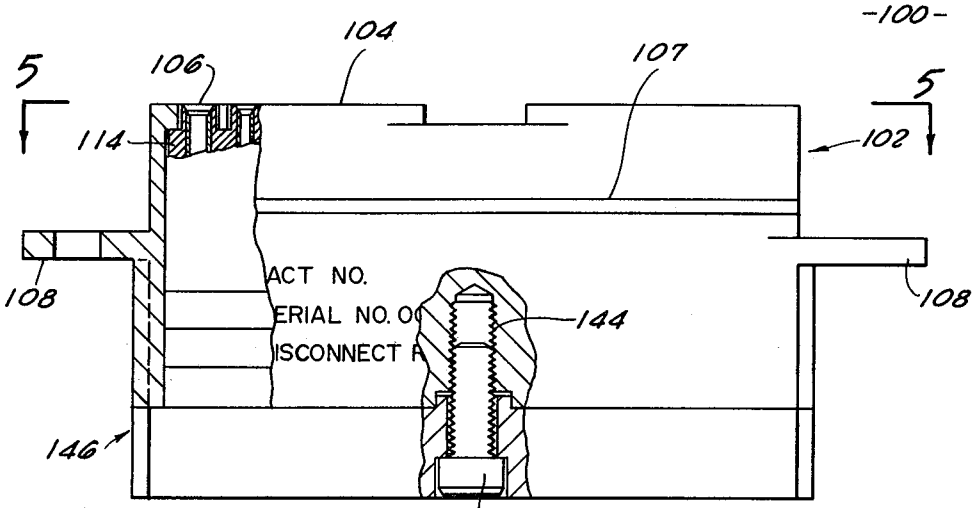
FIG. 4, is a plan view, with two breakouts, of the receptacle as shown in FIG. 2.
Figure 6:
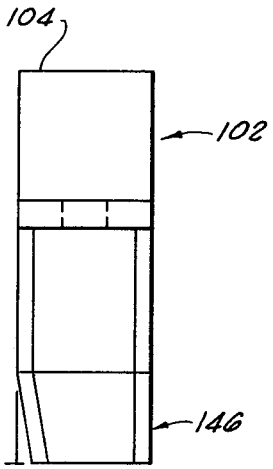
FIG. 6 is a side view of the receptacle as shown in FIG. 4.
Figure 10:
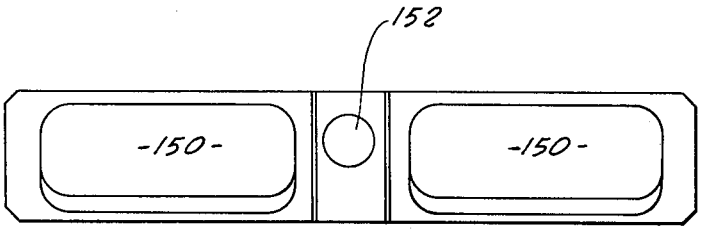
FIG. 10 is a top view of the backshell.

FIGS. 4–6 show views of receptacle section 100 with two cutouts in FIG. 4. One shows two perforations 106 in face 104 and insert 114. Looking down (toward face 104) at section line 5—5 reveals the view of FIG. 5. The two inserts 114 show their socket openings 127, sized for two different contacts. Each opening is identified by numbers to aid in the insertion of contacts into the insert. Located in housing 102 is a threaded cavity 144.

Figure 7:
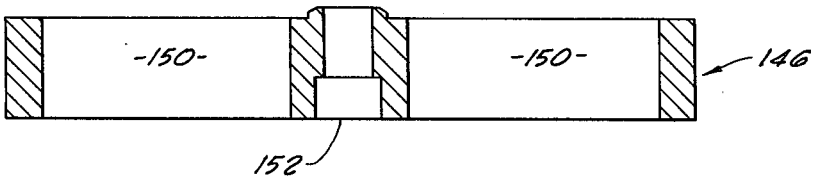
FIG. 7 is a plan cross section of the backshell of the receptacle.
Figure 8:
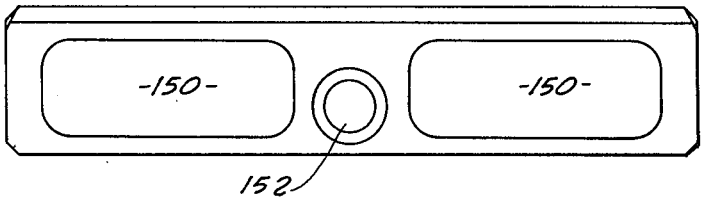
FIGS. 8–9 are a bottom view and a side cross section thereof of the backshell.
Figure 9:
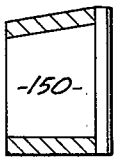

A backshell 146 is affixed to the rear end of housing 102 by way of bolt 148 threaded into cavity 144. Backshell 146 is provided with two elongated openings 150 (conduits) affording electrical lead exit provisions from the inserts 114 (FIG. 4). Backshell 146 is provided with a central round passage 152 (FIGS. 7–8) for bolt 148. FIG. 9 is a cross-section showing one elongated side is inclined but this configuration is not essential. After the electrical leads have been fitted to the socket barrels 112, then passed through openings 150, the empty space at the rear of receptacle housing 102 is desirably filled with plastic and metal powder which can attenuate RFI and X-rays. Thereby the leakage of such radiation into the vehicle electrical system is further minimized.

FIGS. 11–12 show one of the two inserts 114 used in connection with receptacle 100. Insert 114 is made up of three pieces 116, 118 and 120. Each piece includes a number of cylindrical passages 126 whose size is determined by the dimensions of the particular pin socket and barrel. Two combinations appear in insert 114; six of one size and four of a smaller size (FIG. 12). Insert piece 116 is provided with tubular extensions 117 for insulating the metal face 104 from the pins 206, when in the mated relation. Insert piece 118 provides space in its opening 126 for elements which lock the pin socket 110 in place. Insert pieces 116 and 118 are preferably made of glass filled epoxy resin. Insert piece 120 is a grommet seal, preferably made of silicone rubber.

A desirable safety feature is shown in FIG. 5. The face 104 is rounded at two corners 105. Corresponding rounded corners in the mouth of the plug section result in an indexing feature which allows the two sections to fit together in only one unique manner.

X-ray attenuation by inserts 114 can be improved by using a suitable metal powder as a filler or part of the filler for the plastic material out of which the insert is formed.

X-ray radiation entering receptacle 100 parallel to perforations 106 will be absorbed in part by the socket. Should it be desirable to decrease the amount of such energy passing beyond the pin socket and reaching the electrical leads to the vehicle electrical system, suitable metal washers can be positioned below barrels 112 to intercept X-rays not absorbed earlier. Another expedient is to position a perforated metal plate (compression plate) beneath the insert 114 which plate aids in the attenuation of "parallel" X-rays and also further attenuate "angular" entry X-rays.

Perforations 106 in face 104 are open to the entry of RFI energy when the connector has been disengaged and the plug section withdrawn. In typical connectors, RFI energy can enter through the open perforations in the receptacle face into the interior of the receptacle, reach the electrical leads, and enter the on board electrical system. When this received energy is of sufficient magnitude, it causes malfunctions of the on board electrical system. In the connector of the invention, the dimensions of said perforations 106 are selected to form wave traps (wave guides) having a cut off frequency above the frequency of radio frequency electromagnetic energy striking face 104 during operational use of receptacle 100. The reader is referred to Phillips U.S.A. Pat. No. 3,550,065 for more detail on wave guides of this nature. This Phillips patent is incorporated herein by reference.

FIG. 13 shows a plan view in partial section of plug section 200 including locking-unlocking means 300. Plug housing 202 includes two plug inserts 210, consisting of insert pieces 212 and 214. These pieces 212 and 214 are preferably made of glass filled epoxy resin. Also insert piece 216 which is a grommet seal, preferably made of silicone rubber. An interface seal member 218, preferably made of fluorosilicone rubber, is positioned on the upper face of insert piece 212. Electrical pins 206, provided with crimp barrels 208 (FIG. 1) are fitted in passages 224 in said insert pieces and are tightly gripped by perforations in interface seal 218. Seal 218 is provided with edge portion 226 which edge aids in environmental sealing when the connector is in mated relation (FIGS. 1 and 13).

A cylindrical passage 230 in plug section 200 accomodates locking means 300.

Figure 16:
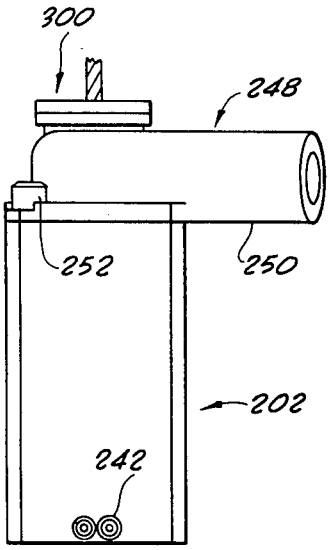
FIG. 16 is a side view of the plug section of FIG. 15.
Figure 15:
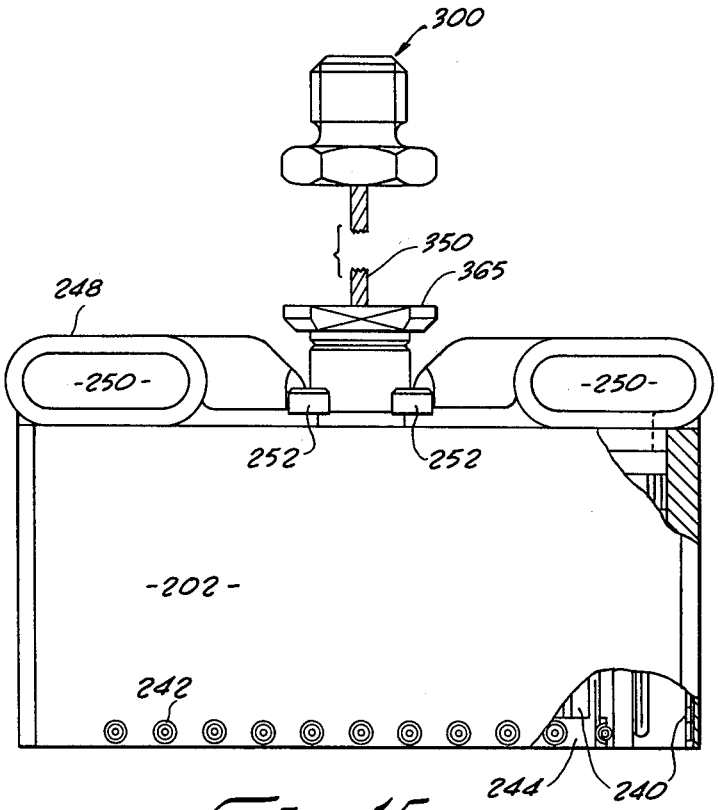
FIG. 15 is a view of the plug section, with two breakouts, showing the backshell with two electrical lead outlets.

Herein six bolts 252, shown in FIGS. 15–16 but not shown in FIG. 14, retain a plug backshell 248 affixed to plug housing 202. Holes 234 for these bolts appear in FIG. 14.

Plug housing 202 extends beyond interface seal 218 to form a walled well opening 204 and lip 205 extending around well 204. It is important that stray electromagnetic energy striking the two housings flow on by way of the housings rather than leak into the interior of the connector. Herein the conductive contact between the exterior of housing 102, when mated, with the interior of opening 204 is improved by the presence of RFI fingers 240 mounted on all the four sides of openings 204 (FIG. 13). For convenience in handling the RFI fingers 240 are manufactured in strips. The opening 204 is drilled around the lip 205 to permit flat flange eyelet fasteners 242, which hold the fingers 240 tightly against the wall of opening 204. The RFI finger strips 240, retainers 244 and eyelets 242 are preferably made of gold plated beryllium copper alloy. The locations of RFI strips 240 are set out in FIG. 13 and in FIG. 17 where one looks into opening 204. To simplify the drawing, these RFI strips have been omitted from FIG. 1.

Figure 17:
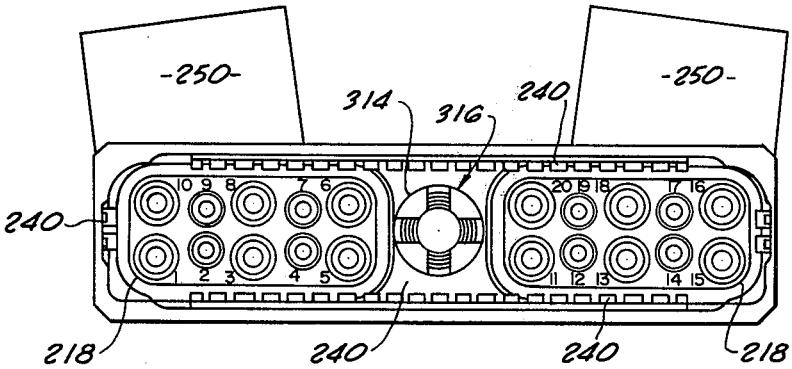
FIG. 17 is a view of the open end of the plug: the lower end of FIG. 15.
Figure 19:
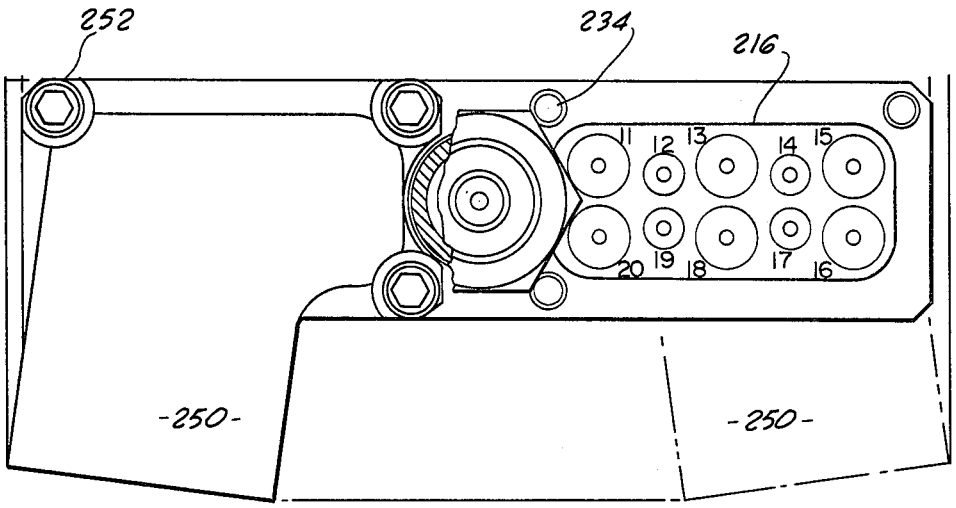
FIG. 19 is a partial section of the view of FIG. 18 showing the top of the backshell and of one grommet seal.
Figure 18:
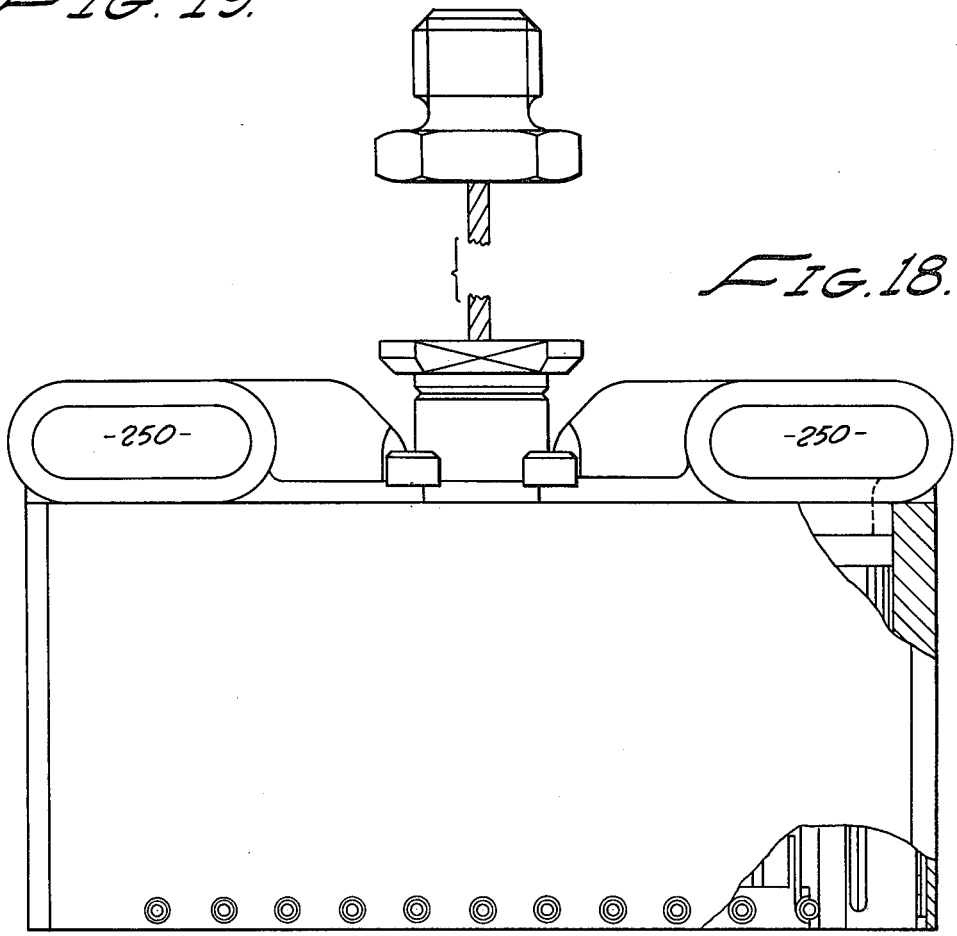
FIG. 18 is a repeat of FIG. 15 to a different scale.

FIGS. 15 through 19 show the plug backshell 248 which is affixed to lead exit end of the plug housing 202; the backshell 248 has a 90° turn away from the line of the plug housing. Each insert 210 has its exit conduit 250. FIG. 17 is a view into opening 204 showing backshell conduits 250. (FIG. 18 is the same as FIG. 15 but on a larger scale FIG. 19 is on the same scale as FIG. 18) FIG. 19 gives a look down on backshell conduit 250—one is in a broken out view showing passage 230 and insert piece 216, three bolts 252 and three bolt holes 234.

The plug housing, receptacle housing and the back shells are made of galvanic compatible metal and, preferably, are made of the same type of metal.

Figure 20:
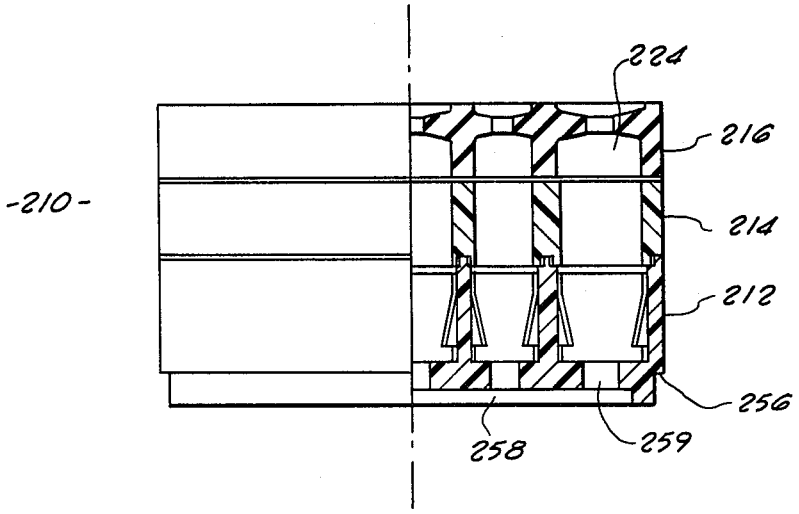
FIGS. 20–21 are a partial sectional plan view, and a bottom view thereof, of an insert for the plug section.
Figure 21:
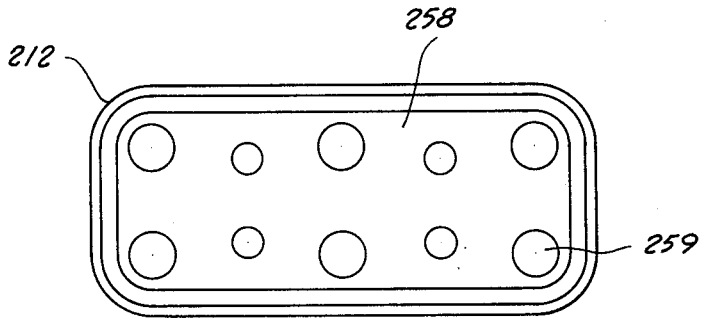

FIGS. 20–21 show one of the two insert assemblies 210. Insert piece 216 is a grommet seal, preferably made from silicone rubber. Insert piece 212 is provided with outer shoulder 256 and a shallow rectangular indent 258 to better support interface seal 218. Shoulder 256 aids in positioning in 226 of seal 218 (see FIG. 13). Preferably insert pieces 212 and 214 are made from glass filled epoxy resin.

Locking-unlocking means 300 comprises, in combination: a tubular collet member 310 (FIGS. 1 and 13) is provided with a number of collet fingers 312, each finger 312 terminates in a finger tip 314. Collet fingers 312 and finger tips 314 are capable of closing the finger tips into a rough ball shape 316 (FIG. 17) and also opening to an expanded diameter, i.e., expanded with respect to the ball shape diameter. Collet 310 is a sliding fit in plug passage 230 (numeral shown in FIG. 1). Collet 310 is retained in passage 230 by collar 320 positioned on the split tube of the collet fingers 312 behind the collet fingertips 314; collar 320 acts against the front face 231 of the plug housing wall establishing passage 230. Receptacle housing 102 includes recess 130, which is capable of receiving collet fingertips 314 and part of the lower end of collet fingers 312 and also accepts the fingertips 314 when expanded beyond the ball shape 316 (FIG. 17). The wall of recess 130 is provided with an annular protusion 132 decreasing the internal diameter of recess 130 to just larger than that needed to pass the ball shape 316. Collet fingers 312 have a knuckle protusion 315 extending outwardly enough to make contact with collar 320 closing the fingers and holding the plug in ready to mate position, (see FIG. 13).

It is seen that recess 130 ends with a thickness of metal such that any EMI leakage into passage 230 and recess 130 is attenuated in both housings rather than entering the interior of the connector.

The rear of collet fingers 312 are encircled by a helical spring 330 which fits between shoulder 318 of collet 310 and shoulder 235 of the wall of passage 230.

A plunger rod 340 of a diameter capable of entering the empty space between the fingertips 314 in the ball position and expanding the fingertips is positioned inside collet 310. Plunger 340 is provided with a long hole, not shown, for receiving a lanyard cable end.

Plunger 340 is one element in a lanyard assembly, not numbered. The lanyard assembly herein comprises: Plunger 340 (FIGS. 1 and 13). Lanyard cable 350 is made of corrosion resistant steel cable. A stabilizer fitting 360 (FIG. 1) which rests on the rear end of plunger 340—the front of the locking means 300 is located at the collet fingertips 314. A lanyard guide 365 is supported by the rear end of collet 310. A plunger spring 370 is positioned and supported between stabilizer 360 and guide 365 (FIGS. 1 and 13). Near the rear end of lanyard 350 a swage fitting 375 (FIG. 13), a metal ball swaged about the lanyard cable 350, is located to permit affixing the lanyard to a solid surface by way of retaining nut 380 slidably positioned on the lanyard to the front of swage fitting 375. It is seen that lanyard 350 is affixed to plunger 340, passes through stabilizer 360, guide 365, retaining nut 380 and roughly terminates at swage fitting 375.

In the mating (engaging) of the two sections 100 and 200, the receptacle face 104 is lined up with plug opening 204 by the indexing means 105 and the two sections are pushed toward each other until a "mating line" 107 (see FIG. 4), enscribed onto the receptacle housing exterior, disappears. The resistance of the pins entering the socket is great enough that the "mating line" is a valuable safety indicator of full mating. While the two sections are apparently solidly engaged after mating, vibrations and other movement of the connector can cause unmating and separation of the two sections.

The two sections are locked as follows: Locking means 300 is placed in operative position by having collet 310 in fully back location; at this location collet fingertips 314 are in the ball shape and a push on lanyard guide 365 forces collet 310 to move forward until the collet fingertips 314 pass beyond the annular protusion 132 in receptacle recess 130. The collar 320 now is free of the knuckle protusion 315. The plunger spring 370 forces the plunger 340 forward and cams the fingertips 314 to an expanded diameter greater than the internal diameter of protusion 132. At this condition collet fingertips 314 cannot be withdrawn from recess 130 and the plug and receptacle sections are locked. For the same desirable ends, a "locked line" is enscribed on the exterior of collt 310. These forward movements (indicated by the large arrow "lock" in FIG. 1) also compress spring member 330. Compressed plunger spring 370 maintains the full forward position of plunger 340 and the expanded shape of the collet fingertips.

The connector is unlocked and disengaged as follows: Lanyard cable 350 is pulled taut to overcome plunger spring 370, permitting plunger 340 to be withdrawn; this withdrawal permits the fingertips to retract into the ball shape. The unlocked connector halves are now free to separate under the load in lanyard 350. Compressed spring 330 forces the collet 310 and associated lanyard assembly rearward enough for the fingertips to clear protusion 132, and the protusion 315 strikes the collar 320 camming the collet end 314 closed which then prevents the plunger 340 from going forward. This positions the plug section in the ready to mate condition for the next mating.

The herein described locking-unlocking means 300 has a safety feature. Should the collet 310 and guide 365 be pushed inwardly when the plug section is not engaged with the receptacle section, the plunger forces the fingertips into expanded configuration. The expanded fingertips cannot enter recess 130 fully and the two sections will not mate and no electrical coninuity is made between contacts. Actually an immediate mismatch occurs and the operator is alerted to look for trouble—easily discernable by visual inspection of the plug pin opening, revealing the expanded fingertips.

It is to be understood that the hereinabove described invention is not limited to the preferred embodiment illustrated. Other embodiments may be readily devised with the aid of this description.

Thus having described the invention, what is claimed is:

1. A multi-contact plug and receptacle electrical connector comprising:

A. the receptacle comprising:

a conductive metal housing for mating with the plug including a face having perforations therein, said metal being capable of absorbing a substantial amount of X-ray radiation striking said face;

said face being thick enough to cause X-ray radiation entering said perforations at an angle to said face to be shielded from striking the electrical sockets positioned beneath said perforations;

the dimensions of said perforations being selected to form wave traps having a cut-off frequeny above the frequency of radio frequency electromagnetic energy striking said face during operational use of said receptacle; and an insulator insert positioned beneath said face enclosing the sides of said sockets;

B. the plug comprising:

a conductive metal housing for mating with said receptacle, said plug metal being capable of absorbing a substantial amount of X-ray radiation striking said plug;

an insulative insert positioned within said plug housing, said plug insert enclosing a portion of the length of electrical pin contacts for making electrical connection with sockets of said receptacle, and also enclosing a barrel portion of said pin contacts;

C. means for locking said receptacle and said plug in the mated relation;

D. means for rapidly unlocking said plug and receptacle and for disengaging said plug and receptacle from the mated relation; and E. said means for locking and for rapidly unlocking said receptacle and plug including, in combination with said plug, a tubular means terminating in collet fingers, each of said fingers terminating in a finger tip, said finger tips being capable of closing to a roughly ball shape and opening to an expanded diameter;

a plunger movable longitudinally within said collet fingers and said collet finger tips, whereby when said plunger is in the extreme forward position, said finger tips cannot move inwardly and are locked in the expanded position within a recess included in said receptacle;

spring means associated with said plunger for maintaining said plunger in the forward position;

spring means associated with said tubular means for imparting rearward movement of said collet finger tips out of said recess, whereby said receptacle and said plug are unlocked and electrically disengaged.

2. The connector of claim 1, wherein said plug housing includes conductive metal fingers for improved conduction contact of said two housings when the connector is in the mated relation.

3. The connector of claim 1 wherein there is further included a lanyard, pull on which overcomes said plunger associated spring force, withdrawing said plunger sufficiently to allow said fingertips to assume the ball shape, permitting said fingertips to escape from said recess.

4. The connector of claim 1, in which the electrical connector is a flat pack connector.

* * * * *